US005469688A

United States Patent [19]

Dunbar et al.

[11] Patent Number: 5,469,688

[45] Date of Patent: Nov. 28, 1995

[54] METHOD FOR WRAPPING SILVERWARE IN A NAPKIN

[75] Inventors: Michael D. Dunbar, 873 Neil Ave., Columbus, Ohio 43215; Vincent J. Vohnout, Columbus, Ohio

[73] Assignee: Michael D. Dunbar, Columbus, Ohio

[21] Appl. No.: 97,847

[22] Filed: Jul. 26, 1993

[51] Int. Cl.[6] ..... B65B 51/06; B65B 11/00

[52] U.S. Cl. ..... 53/419; 53/461

[58] Field of Search ..... 53/419, 461, 137.2, 53/138.1, 176, 449, 216, 215, 211, 209, 397

[56] References Cited

U.S. PATENT DOCUMENTS 3,394,804 7/1968 Reichel .
3,659,394 5/1972 Hartleib et al. .
5,046,297 9/1991 Lippert et al. .
5,117,928 6/1992 Weihe .

*Primary Examiner*—Linda Johnson
*Attorney, Agent, or Firm*—C. Michael Gegenheimer

[57] ABSTRACT

An apparatus and method for automatically wrapping at least one eating utensil in a napkin includes a receiving area for at least one utensil and at least one napkin, and a mechanism for automatically wrapping. The mechanism for automatically wrapping includes a frame, a flexible belt disposed in the frame, and a belt manipulation device. The belt has a first surface adapted for frictional contact with the napkin. At least a portion of the belt is movable to form a trough in which the napkin and utensil are manipulated and urged by frictional contact with the belt to fold and roll, automatically wrapping the utensil.

7 Claims, 9 Drawing Sheets

METHOD FOR WRAPPING SILVERWARE IN A NAPKIN

BACKGROUND OF THE INVENTION

The present invention relates to equipment for the food service industry, and in particular, to an apparatus and method for wrapping silverware in napkins for use as place settings.

Within a large segment of the food service industry, food service providers serve millions of customers reusing a small inventory of silverware, also referred to herein as eating utensils, which are washed after each use. Because individually handling eating utensils to set places at tables is time-consuming, a significant number of food service providers supply eating utensils in bundles which are prepared well in advance of use by manually wrapping the necessary utensils in napkins. While this procedure permits more rapid dispensing of utensils when needed, and facilitates the rapid resetting of tables for use, such preparation remains labor intensive. For high volume restaurants and chains, the labor costs may be in the tens of thousands of dollars annually per restaurant.

Accordingly, the need exists for improvements in preparing eating utensils for place settings which achieves the benefits of rapid dispensing thereof, at lower cost.

SUMMARY OF THE INVENTION

The present invention satisfies that need with a method and apparatus for automatically wrapping at least one utensil in a napkin.

In accordance with the method of the present invention, at least one utensil and at least one napkin are positioned in a receiving area of an apparatus for automatically wrapping, and the napkin is manipulated with an automatic wrapping mechanism to wrap the utensil with the napkin.

The surface of a napkin can be said to include first and second side portions and a central portion therebetween. In accordance with the preferred method, the utensil is positioned in one of the portions of the napkin, and manipulation thereof is performed by automatically folding one of the side portions into generally opposing relationship with at least part of another portion. This folding action further tends to urge the utensils 12 towards the central portion of the napkin. Continued manipulation urges the opposing portions to wrap in unison generally around the utensils. A flexible belt in frictional contact with the napkin is preferably used to produce the desired folding and wrapping thereof.

In a further aspect of the present invention, an apparatus for wrapping utensils in a napkin is provided which includes a receiving area and a mechanism for automatically wrapping at least one napkin around at least one utensil provided in the receiving area. The mechanism for automatically wrapping includes a frame and a flexible belt disposed in the frame, and a belt manipulation device. The belt has a first surface adapted for frictional contact with the napkin, and at least a portion of the belt is movable, enabling the belt to manipulate of the napkin. The belt manipulation device moves the belt to urge the napkin in contact therewith to automatically wrap the utensil.

The present invention makes possible the preparation of eating utensils in bundles with reduced labor input, and is capable of higher speeds than can be achieved manually, providing significant cost savings to food service providers. The apparatus may be further provided with means for securing the wrapped utensils in a wrapped condition, such as a dispensing device for applying gummed napkin rings or bands to the napkin after wrapping. During operation, napkins may be dispensed manually or automatically to the receiving area. As well, the silverware may be placed manually in a hopper and delivered manually into the receiving area, or the entire process automated with an automatic silverware sorting apparatus, and means for automatically delivering silverware to the receiving area.

Accordingly, it is an object of the present invention to reduce labor costs required for silverware preparation.

It is a further object of the present invention to increase the speed at which silverware can be prepared in bundles for use.

It is a still further object of the present invention to provide an apparatus which may be used to wrap one or more eating utensils in a paper or cloth napkin for use.

These and other features and benefits of the present invention are set forth in greater detail in the drawings and detailed description which follow.

DETAILED DESCRIPTION OF THE PREFERRED EMBODIMENTS

Figure 1:
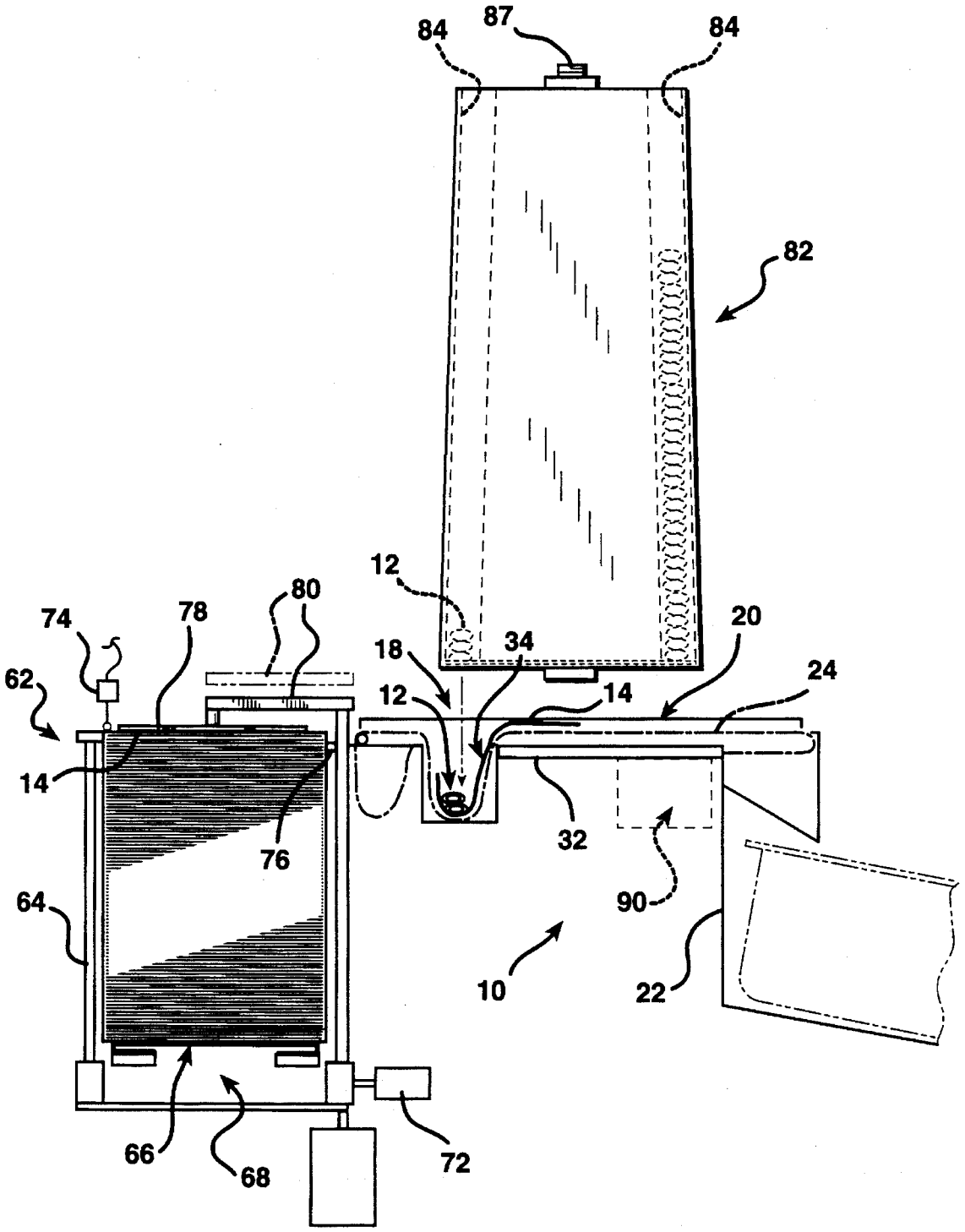
FIG. 1 is a schematic side elevation view of the apparatus of the present invention in one embodiment.
Figure 2:
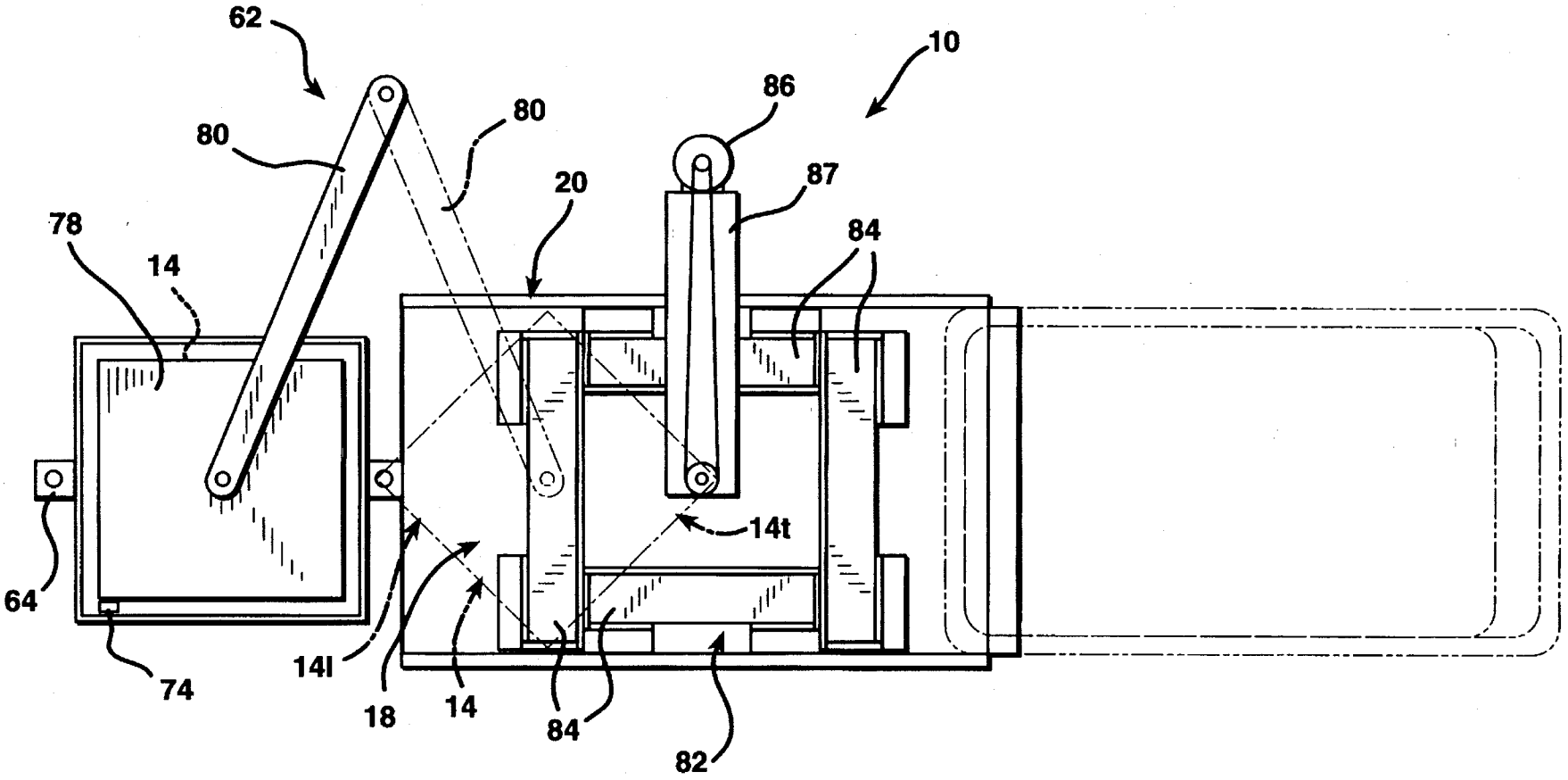
FIG. 2 is a schematic plan view of the apparatus of FIG. 1.

Referring to FIGS. 1–2, a representative embodiment of the wrapping apparatus 10 for wrapping utensils 12 in a napkin 14 is shown configured for completely automatic operation. In accordance with the present invention, the apparatus 10 includes a receiving area 18 and a mechanism 20 for automatically wrapping at least one napkin 14 around at least one utensil 12 provided in the receiving area 18. Completely automatic operation is provided by including a napkin dispenser 62 which automatically loads at least one napkin 14 in the receiving area 18, and an utensil dispenser 82 which automatically delivers utensils 12 to the receiving area 18. Means for securing the wrapped utensils 16 in a wrapped condition, such as a gummed band dispenser 90, is further provided to dispense a gummed band 92 around the wrapped utensils 16. Gummed band dispenser 90 is shown in greater detail in FIG. 9. The gummed band 92 serves as a napkin ring to maintain the napkin 14 in wrapped relationship, and preferably includes on one side an adhesive such as those well known for use with postable note papers.

Figure 3:
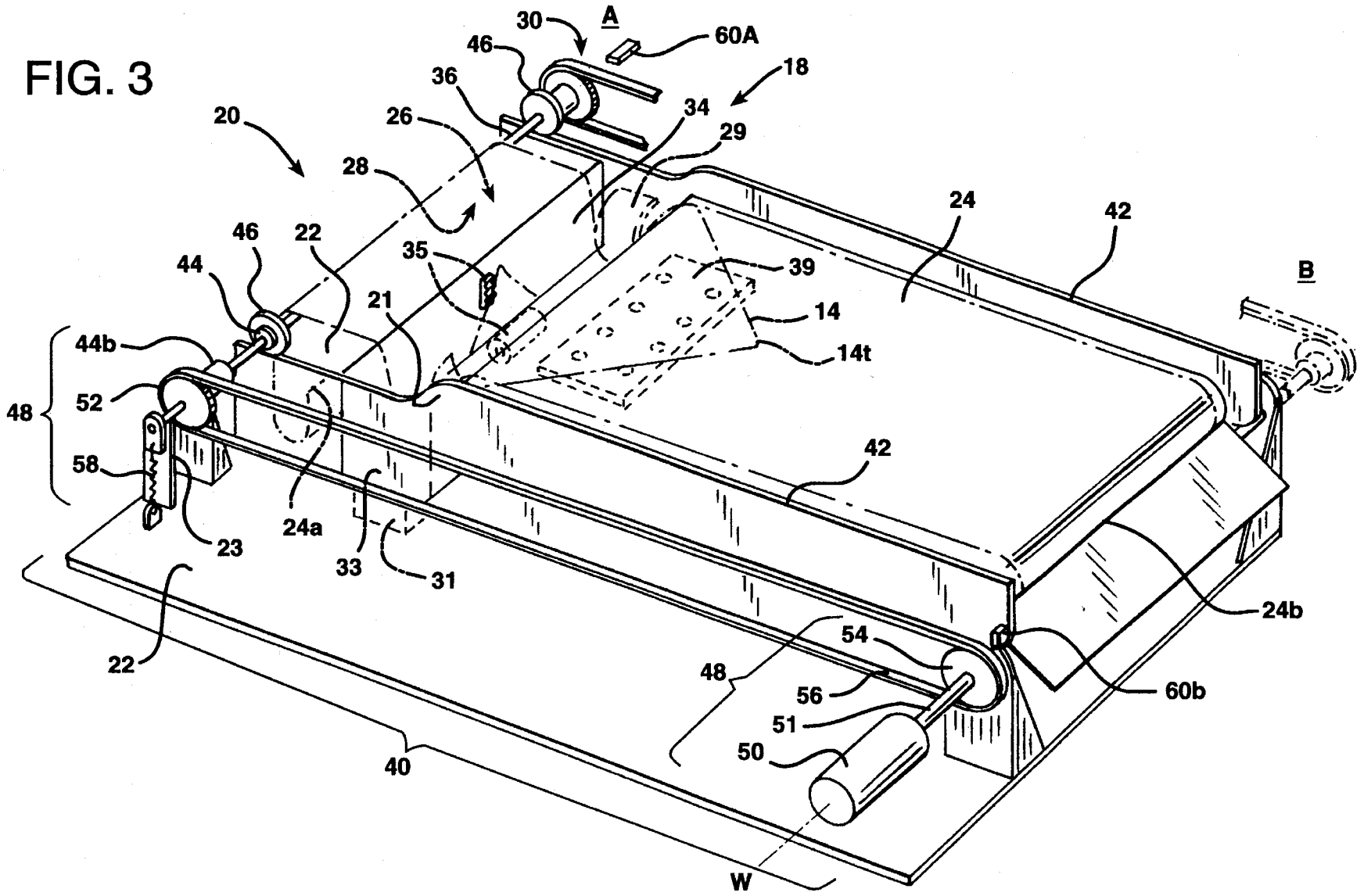
FIG. 3 is a partial schematic perspective view of the automatic wrapping mechanism of the present invention.

Referring now to FIG. 3, the mechanism 20 for automatically wrapping includes a frame 22, and a flexible belt 24 therein. The flexible belt has a first surface 26 for frictional contact with at least a portion of a napkin 14 provided in the receiving area 18. At least a portion of the flexible belt 24 is movable for manipulation of a napkin 14 so provided. The mechanism 20 for automatically wrapping includes a belt manipulation device 30 to move the movable portion of the belt 24 to urge the napkin 14 in contact therewith to automatically wrap the utensils 12.

As shown in FIG. 3, it is preferred that the flexible belt 24 is connected at its opposite ends 24*a*, 24*b*, to the frame 22, with the movable portion of the belt 24 positioned between the ends. The frame 22 preferably includes a generally planar supporting surface 32 (shown best in FIG. 1), such as a flat surface or screen, which is in contact with the preferably low friction second surface 28 of the flexible belt 24 and supports at least a portion of the movable portion thereof. A part of the movable portion of the belt 24 extends beyond the planar supporting surface 32, and forms a first trough 34, as shown in FIGS. 1 and 3.

The supporting surface 32 may further include a means for restraining a portion of the napkin in a flat position in the receiving area. One such means for restraining is a vacuum table 39, shown in phantom in FIG. 3, which provides suction pressure on napkin 14 through the interstices of the flexible belt material. Such restraint is maintains the position of napkin 14 against undesirable displacement when loading utensils 12 upon a portion of the napkin 14 extending into the trough 34.

The trough 34 is formed in the flexible belt 24 prior to wrapping either by gravity, or with assistance of mechanical means such as fingers (shown in FIG. 6), or trough vacuum means 31, as indicated in phantom in FIG. 3. As further indicated in phantom, the trough depth may be varied by adjusting the level of trough plate 33 with a gear drive 35. The trough depth is variable to accommodate different types of napkins 14 which may have varying flexibility and size, and is variable to accommodate varying numbers of utensils 12.

Figure 5A:
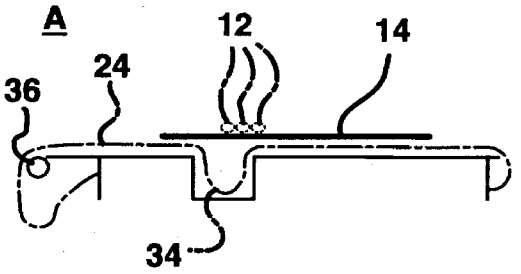
FIGS. 5A–5E are partial schematic side elevation views of the napkin, utensils and belt shown in corresponding FIGS. 4A–4E.
Figure 5B:
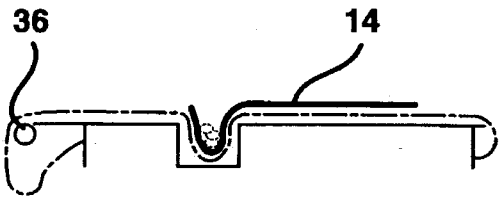
Figure 5C:
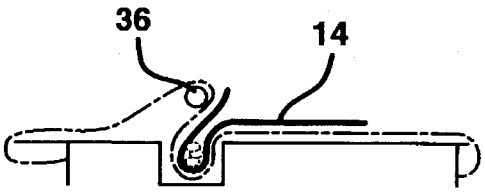
Figure 5D:
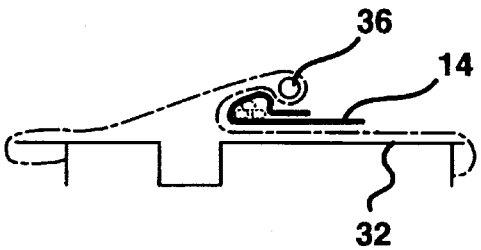
Figure 5E:
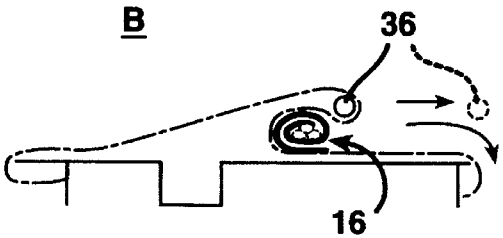

Still referring to FIG. 3, in the preferred embodiment, the belt manipulation device 30 preferably comprises a slidable, rotatable first rod 36 extending across the flexible belt 24 in contact with the second surface 28 thereof. The first rod 36 has a first position A, shown in FIGS. 3 and 5A, near end 24*a* of the flexible belt, where it is positioned prior to automatically wrapping, and a second position B nearer the opposite end 24*b* of the flexible belt 24, as shown in FIG. 5E, where its travel terminates after producing wrapped utensils 16.

The belt manipulation device 30 further includes a rod positioning device 40 connected to the first rod 36, to automatically move the first rod 36 between its first position A and second position B. It is preferred that the rod positioning device 40 include a pair of fixed cams 42 extending from the first position A to the second position B along the sides of the belt 24, defining a path of travel for the first rod 36 along the frame 22. At least one, and preferably two cam followers 46 attached to the first rod 36 through bearings 44 allow free rotation of the ends of the rod 36 and cam followers 46 as they move along cams 42.

Rod positioning device 40 also includes a drive 48, such as a belt drive rotatably driven by a reversible drive motor 50. Alternatively, the drive 48 could include a hand crank. The drive 48 includes identical elements on both sides of the flexible belt 24, except for the motor 50, and the description which follows applies to portions of the drive 48 on each side of the belt 24.

Drive 48 further includes first and second pulleys 53, 54 and a drive belt 56 which extends therebetween. Second pulleys 54 are mounted on drive axle 51, while first pulleys 52 are mounted to respective sub-frames (which are not shown for clarity) extending between the first and second pulleys 52, 54. The sub-frames pivot around axis W. Motor 50 connects to drive axle 51 to rotatably drive the second pulleys 54, and the drive belt 56. The drive belt 56 is positively connected to the first rod 36 via a bearing 44*b* which allows the first rod 36 to freely rotate as the drive belt 56 moves the first rod 36 along the cams 42. Such positive connection of the rod to the drive belt 56 also causes permits the cam 42 and cam follower 46 to provide some support to the drive 48.

At the first pulley 52, the drive 48 is supported by the frame bearing pad 23. First pulley 52 is also attached to the frame 22 by a spring 58 which allows vertical displacement of the cam follower 46 as well as additional vertical displacement of the first rod 36 to accommodate vertical displacement in the position of first rod 36 during wrapping. The rod positioning device 40 of FIG. 3 is preferred as it provides flexibility in the vertical location of first rod 36 by permitting both deflection of the drive belt 56 and extension of the spring 58. As well, the belt drive permits some belt slippage in the event of jamming. A motor clutch (not shown) also may be provided to disengage the drive motor 50 in the event of jamming.

First and second limit switches 60*a*, 60*b* or other motor control means may be used to control the travel of the first rod 36 between the first and second positions A, B. Upon reaching a limit switch, the drive motor 50 reverses to return the first rod 36 to its opposite position.

During operation, illustrated in FIGS. 5A–5E, the preferred belt manipulation device 30 permits the first rod 36 to rotate due to frictional contact with the second surface 28 of the flexible belt 24. In this regard, such rotation prevents wear on the low friction second surface 28 of flexible belt 24 otherwise imposed by a rigid rod. Alternatively, the surface of the first rod 36 may be worked (e.g. knurled) to increase friction, if desired, and additional ribbing may be provided in the first rod 36 to assist in urging the napkin to wrap.

It is understood that numerous other rod positioning devices 40 are possible to provide the desired motion of first rod 36 and flexible belt 24, and that FIG. 3 is illustrative of one, preferred embodiment. For example, an alternative rod positioning device 40 (not shown) may employ a pair of coordinated screw drives, each rotatably driven by a drive motor 50 located along axis W near second end B, and which is also pivotable about axis W. The screws of the screw drive extend from end B to end A, on each side of the flexible belt 24, and a drive nut is connected through a rotatable bearing to the first rod 36. Rotation of the screws by drive motor 50 causes the drive nut to move along the length of the screw, moving the first rod 36 between the first position A and second position B along cams 42. The screws may be supported in like manner as the first pulley 52 at the end A, with a bearing pad 23 for support and a spring 58 for vertical displacement.

Another alternative rod positioning device 40 (not shown)

may employ a grooved first rod and a mating, ribbed second surface 28 of belt 24. Rotation of the grooved first rod imposed by a traveling motor, permits the grooves to mesh with the ribs on the second surface 28, advancing the grooved first rod from the first position A to second position B along the cams 42. Reverse rotation of the motor 50 returns the grooved first rod to the first position A.

Other variants of the present invention may include rod positioning devices 40 using levers, rotating cams, gears drives, pistons and the like, and such rod positioning devices are contemplated to fall within the scope of the present invention. Regardless of the precise drive 48 used, the transit of the first rod 36 along the second surface 28 of the flexible belt 24 across the frame 22 causes the flexible belt to automatically roll a napkin 14 around at least one utensil 12, as shown in FIGS. 4A–4E and 5A–5E.

The mechanism 20 for automatically wrapping may further include an element for tucking which urges one end of the napkin 14 adjacent to one end of the utensils 12 to tuck inward during wrapping to close off one end of the bundle thus formed. This element may comprise a fixed feature 21 (shown in phantom in FIG. 3) on the frame 22 which causes the napkin positioned in the receiving area to form a tuck (indicated in phantom in FIGS. 4C–4E), or may be a moveable element, such as a large leaf spring 29, as shown in phantom in FIG. 3, which contacts an edge portion of the flexible belt 24 to urge an end to tuck.

Once the wrapped utensils 16 are produced, they are discharged from the flexible belt 24 by continued motion of the first rod 36 towards the second end B, as indicated in FIG. 5E. Where a gummed band is to be placed around the wrapped utensils 16, it is preferred to apply it from a dispenser 90, such as a roll and cutter dispenser shown in FIGS. 1 and 9, which may be fed from beneath the supporting surface 32 through a slot in the flexible belt 24. Alternatively, a pre-cut gummed band may be positioned on the surface of the flexible belt 24 by a finger mechanism, or pre-applied to the outer surface of the napkin 14 on its trailing edge **14*t*** prior to wrapping.

Figure 6:
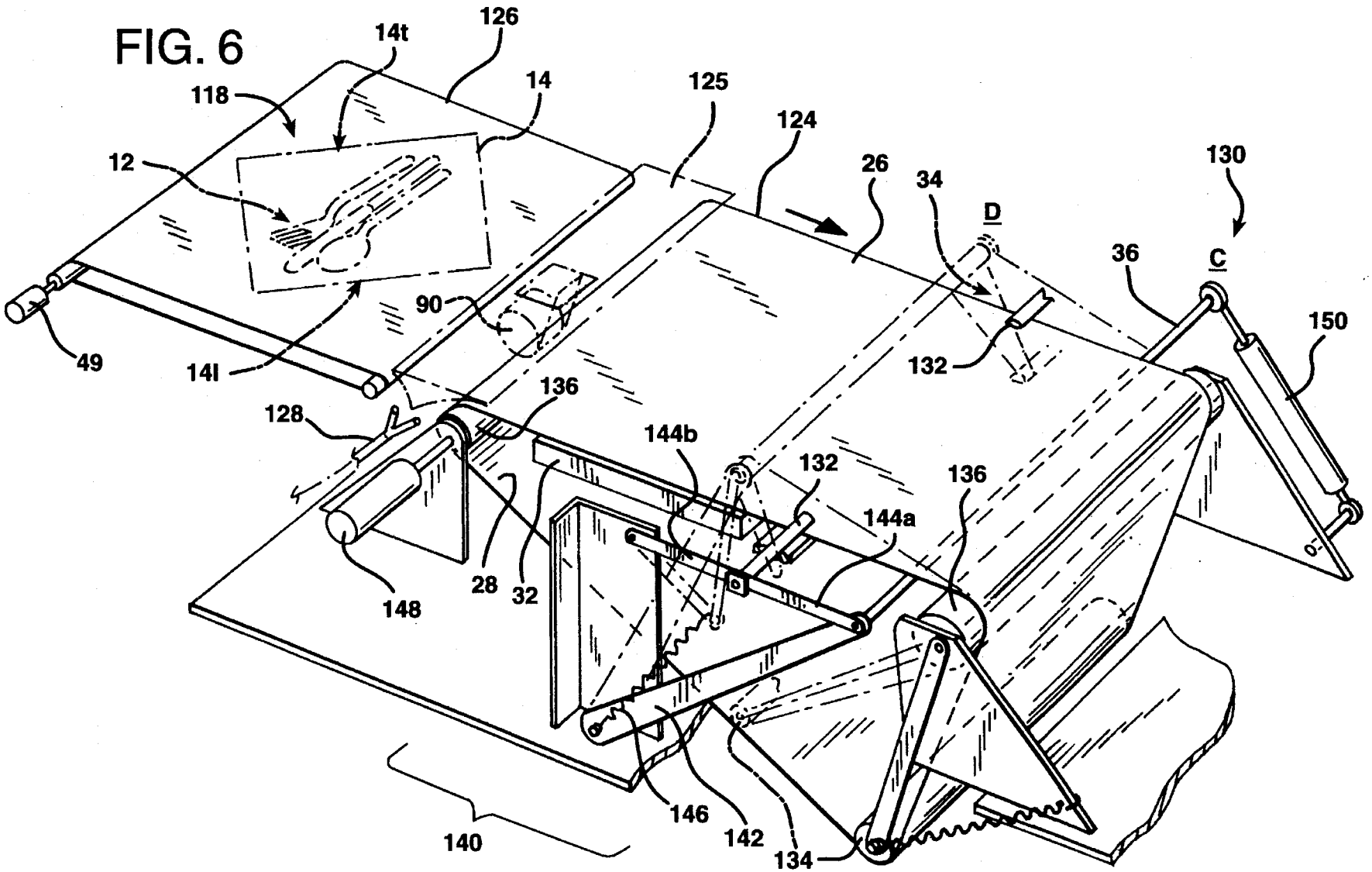
FIG. 6 is a partial schematic perspective view of an alternative embodiment of the automatic wrapping mechanism of the present invention.

Referring now to FIG. 6, an alternative embodiment of the mechanism 20 for automatically wrapping is shown where like elements have like numbers. In the alternative embodiment, the flexible belt comprises a continuous belt 124 which is rotatable in at least one direction, and thus the entire belt 124 is movable for manipulation of the napkin 14 to automatically wrap the utensils 12. As before, a portion of the belt 124 extends beyond the planar supporting surface 32, and forms a first trough 34, as shown in FIGS. 6 and 7B–7D.

In the alternative embodiment of FIG. 6, the belt manipulation device 130 includes a first rod 36 extending across the belt 124 in contact with the second surface 28, and a generally planar supporting surface 32 spaced from the first rod 36 and supporting a portion of the belt 124. Preferably, the belt manipulation device 130 includes a pair of fingers 132 which extend to contact the first surface 26 of the belt 124 along both belt edges, and are initially positioned between the first rod 36 and the supporting surface 32. The fingers 132 depress a portion of the belt 124 to form the first trough 34.

The belt manipulation device 130 also includes a rod positioning device 140. The rod positioning device 140 moves the first rod 36 from a first position C shown in FIGS. 6 and 7A spaced laterally from the supporting surface 32, to a second position D shown in FIGS. 6 and 7D, spaced closer to, and preferably above, the supporting surface 32 during wrapping. The rod positioning device 140, preferably further positions the fingers 132 to form a first trough 34 in the belt 124 between the first rod 36 and the supporting surface 32. The rod positioning device 140 may, as before, take many forms. In accordance with the alternative embodiment of the present invention, as the motions of the first rod 36 and fingers 132 are more limited, it is preferred to provide a lever mechanism positioned on each side of the belt 124 and shown in FIG. 6 including lever 142, links **144*a* and 144*b*, and spring 146. The lever may be driven by a motor (not shown), piston 150**, solenoid (not shown), manually or other operating means, to cause automatic wrapping.

Figure 7A:
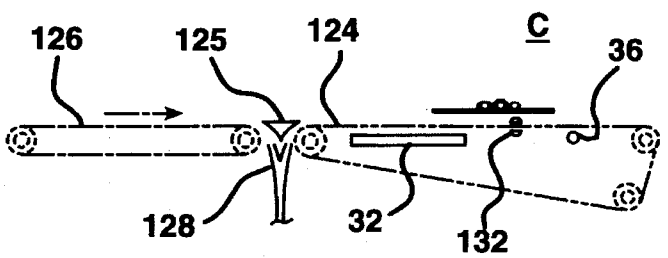
FIGS. 7A–7E are partial schematic side elevation views of a napkin and utensils, and the belt of FIG. 6, in various stages during the wrapping process.
Figure 7B:
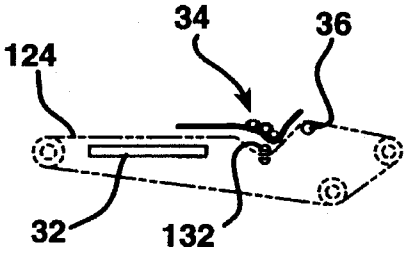
Figure 7C:
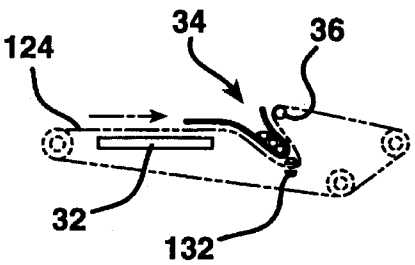
Figure 7D:
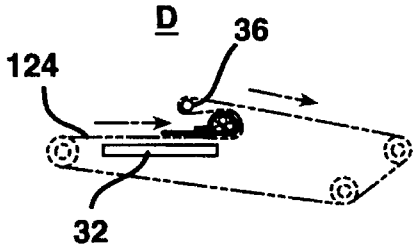

The belt manipulation device 130 further includes a dancer roller 134 to both maintain tension on the belt 124 and permit manipulation of the belt 124 when the fingers 132 depress the belt to form the trough 34 and the first rod 36 moves between the first position C and the second position D. In accordance with the alternative embodiment, in operation, the continuous belt 124 is preferably rotated as shown in FIGS. 7C and 7D when the first rod 36 is moved to its second position D to urge the napkin 14 to wrap around the utensil 12. Drive means 148 for rotating the belt 124, such as a belt drive motor 49 are provided to rotate rollers 136 supporting the belt 124.

Thus, the motion of the first rod 36 from its first to its second position C and D, in cooperation with the supporting surface 32 and rotation of the belt 124 causes the napkin 14 to automatically roll around the utensil 12.

Figure 9:
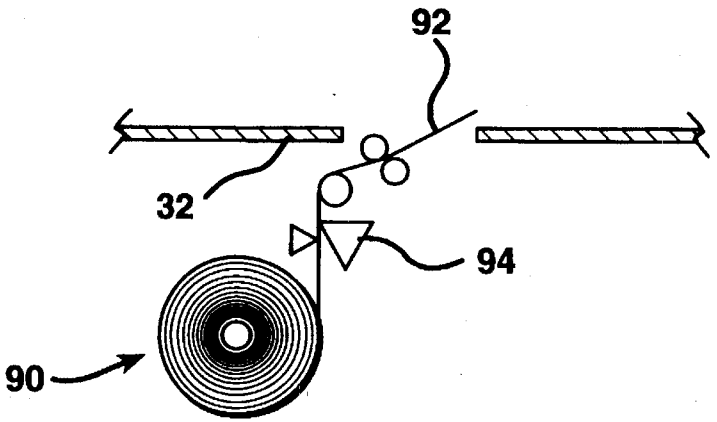
FIG. 9 is a detail schematic view of a gummed band dispenser.

Once the wrapped utensils 16 are produced, they are discharged from the belt 124 (FIG. 7E) by returning the first rod 36 towards its first position C, and continuing the same rotation of the belt 124 as was provided during wrapping. In the alternative embodiment, it is preferred to pre-apply a gummed band 92 to a napkin 14 on its trailing edge **14*t* prior to wrapping. This may be accomplished by mechanically positioning the gummed band in the receiving area, or by applying it from a gummed band dispenser 90, such as a roll and cutter dispenser in like fashion as shown in FIG. 9, through a gap in the flexible belt 124. With this arrangement belt 124** becomes a pair of parallel belts which include a gap therebetween.

Figure 7E:
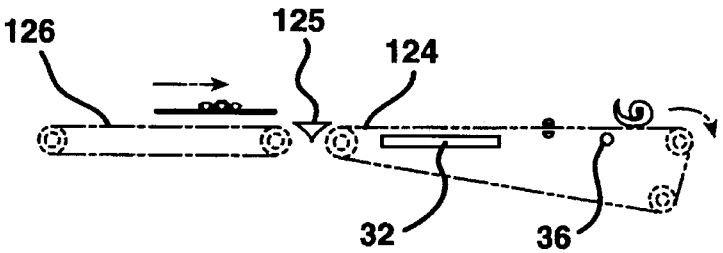

As shown in FIG. 6, for improved production rates, a second, separately rotating, continuous feed belt 126 may be included which provides both a receiving area 118 for receiving a napkin 14 and utensils 12. Thus, the apparatus 10 can wrap a napkin and utensils on belt 124, while simultaneously preparing the next napkin and utensils on feed belt 126. When the belt 124 discharges the wrapped utensils 16, the next napkin 14 and utensils 12 can be simultaneously advanced thereon, as shown in FIG. 7E. A feed belt 126 further permits improved application of gummed bands by making possible the application of gummed bands 92 at the feed belt 126 and receiving area 118 (not shown) in like manner as previously described. As well, the gummed bands 92 may be applied from either below or between a transition element 125 as shown in FIG. 6, or otherwise through a gap between the belts 126 and 124 (not shown). Where a feed belt 126 is used it may be desirable to apply an upward burst of air with air jets 128, connected to a source of positive pressure air, between transition element 125 and belts 126 and 124 to prevent the napkin 14 from diverting therebetween.

The alternative configuration of FIG. 6 has the advantage of requiring only a limited displacement of first rod 36, and requires rotation of belt 124 in only one direction. Further, where a feed belt is used, a second set of utensils 12 may be prepared on a napkin 14 for wrapping, while a first set is being wrapped, increasing the capacity and speed of the apparatus 10. Delivery of the napkin 14 and utensils 12 for wrapping is further improved by the single direction of belt rotation which allows feeding from one end and discharge from the other.

It is understood that a hybrid configuration of the preferred and alternative embodiments of FIGS. 3 and 6 may be used where the continuous belt 124 of FIG. 6 is moved to bring the napkin 14 and utensils 12 into position at the trough 34 in an apparatus where the first rod 36 is configured as in FIG. 3 for movement between first and second positions A and B. To achieve this end, trough plate 33 may be raised to approximately the level of the supporting surface 32 to receive the napkin 14 and utensils 12 to maintain their desired relationship, and then lowered to begin folding and wrapping. The continuous belt 124 can be locked in position during movement of the first rod 36, with necessary slack provided by a dancer roll, to perform in essentially the same manner as in the preferred embodiment of FIG. 3.

Referring now to FIGS. 1 and 2, completely automatic operation of the apparatus 10 can be provided by including a napkin dispenser 62 which automatically loads at least one napkin 14 in the receiving area 18 (or 118), and an utensil dispenser 82 which automatically delivers utensils 12 to the receiving area 18 (or 118). The illustrative napkin dispenser 62 of FIGS. 1 and 2 includes a frame 64 which supports a tray 66, and a tray elevator 68, such as an elevator motor 72 and a conventional belt, chain or gear drive (not shown). Means 70 for controlling the elevator include a stack height sensor 74 to maintain the stack height at the desired level with the motor 72. A tray elevation sensor 76 may also be used to detect when the tray 66 is empty. A vacuum plate 78 is mounted on an arm 80 which pivots as shown in FIG. 2 from the stack to the receiving area 18 (or 118). The arm 80 lowers to pick up a napkin 14 at the stack by vacuum, raises (as shown in phantom) to lift the napkin, and lowers to position the napkin for release at the receiving area 18 (or 118). Such raising and lowering can be induced by action of a cam (not shown) which is engaged when the arm 80 pivots, or by other means. Other napkin dispensing devices are possible, and the dispenser 62 shown is illustrative. Napkins 14 are preferably cloth or paper, and each material will require a slightly different dispensing means. It is noted that the position of the napkin dispensed at the receiving area in FIGS. 3 and 6 is preferably diagonal, so that the leading edge 141 of the napkin actually comes to a point of the napkin, and the trailing edge **14*t* comes to another point. It is also preferable to position folded napkins such that the sides which form the leading edge 141** are folded edges.

Figure 8:
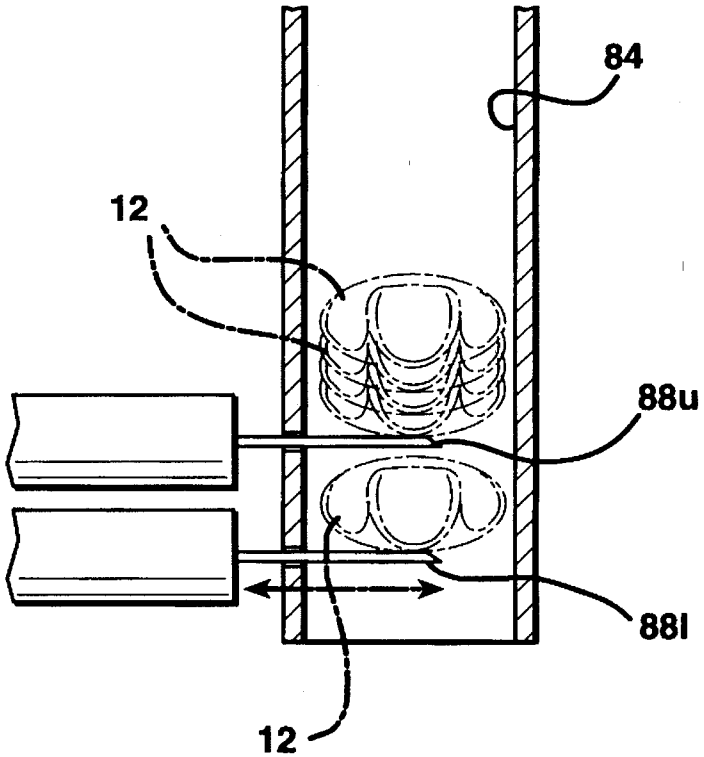
FIG. 8 is a detail schematic cross-sectional view of one utensil magazine of a silverware delivery apparatus.

Further illustratively shown in FIGS. 1 and 2, a utensil dispenser 82 is shown having a plurality of magazines 84, one type of utensil 12 being placed in each magazine 84. A motor 86 mounted on dispenser frame 87 is provided to incrementally position the magazines 84 as desired, for dispensing desired utensils 12 therefrom. Motor 86 is preferably a belt drive motor. Utensils 12 can be loaded in the magazines 84 manually or automatically after sorting. As further shown in FIG. 8, solenoid or air operated pins **88*u*, 88*l* may be used to separate and dispense utensils 12 from the magazines 84. The pins 88*u*, 88*l* are preferably pointed to improve insertion between utensils 12, and extend at least halfway across the width of the magazine 84. One pair of pins 88*l* is positioned below, and one pair of pins 88*u* is positioned above, the bottom utensil 12 in a stack. To dispense a utensil 12, both pairs of pins 88*l* and 88*u* begin in extended position, and the lower pair of pins 88*l* are retracted, while the upper pins 88*u* support the stack. Then, the lower pins 88*l* are again extended, and the upper pins 88*u* retracted to allow the stack of utensils 12 to drop. Then, the upper pins 88*u*** are again extended.

Alternatively, a series of fixed, parallel magazines 84 feeding into a common chute (not shown) can be used to dispense the utensils 12 to the receiving area.

Finally, it is possible to combine an automatic silverware sorting apparatus with the apparatus of the present invention. One such apparatus is shown in U.S. Pat. No. 3,394,804, issued Jul. 30, 1968 to Reichel, to further automate the entire process.

Other features discussed with regard to the preferred embodiment, such as the adjustable trough plate 33 and vacuum table 39, can be also provided in the various alternative embodiments of the present invention to enhance the performance and capabilities of the apparatus 10. As well, other features of the alternative embodiments, such as the feed belt 126, transition element 125, air jets 128, and continuous belt 124 may be added to the preferred embodiment to achieve the advantages thereof.

Figure 10:
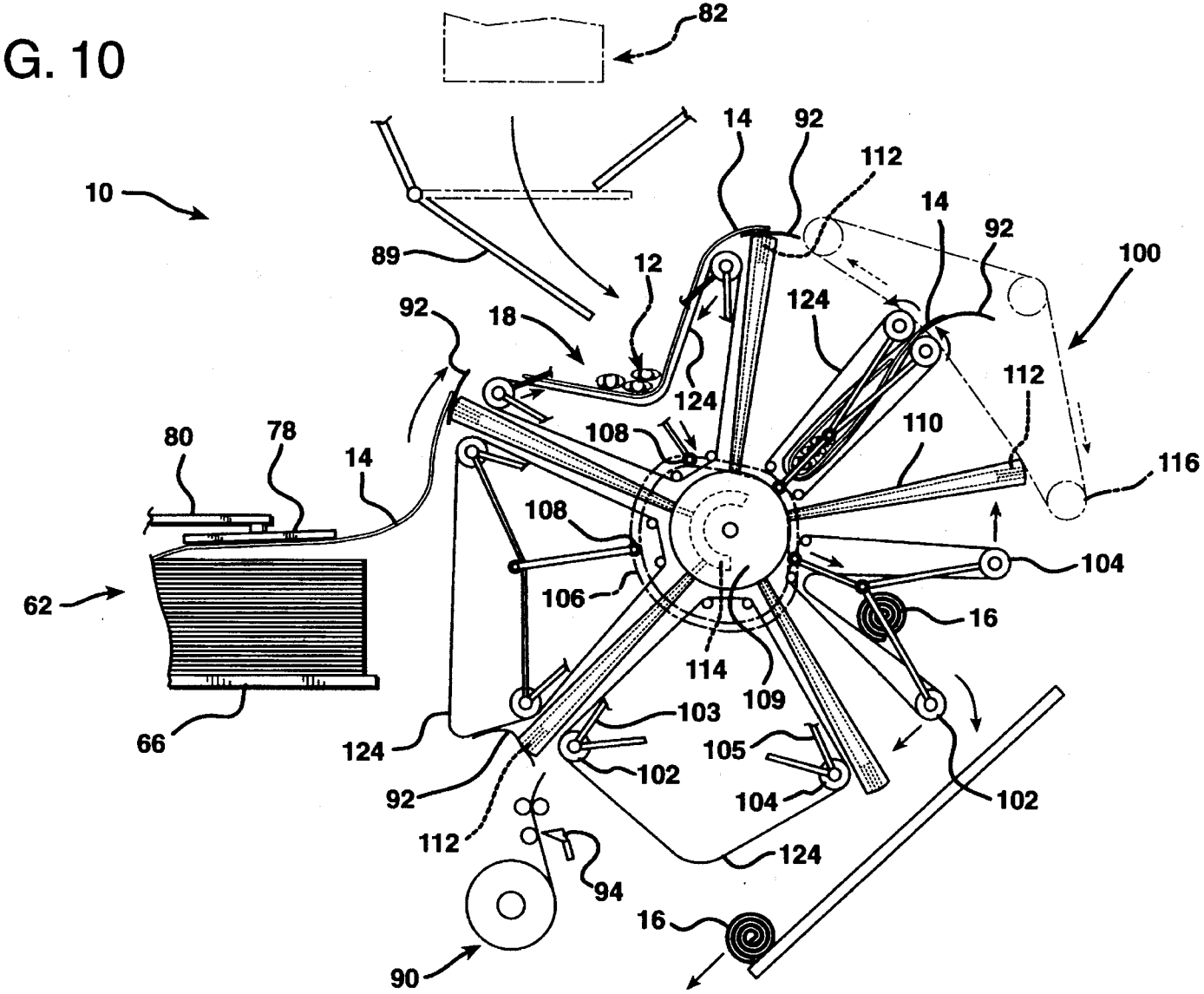
FIG. 10 is a partial schematic perspective view of a second alternative embodiment of the automatic wrapping mechanism of the present invention.

Referring now to FIG. 10, a second alternative embodiment is shown in which like numbers represent like elements. The drum-like arrangement of FIG. 10 is illustrative of the various alternative embodiments which may produce the folding and rolling of the napkin 14 and utensils 12 illustrated in accordance with the present invention in FIGS. 7A–7E. The rotating drum 100 preferably includes five sections, each of which includes a continuous belt 124 mounted on a plurality of rollers. Two larger rollers 102 and 104 are operable from a first, separated position to a second, closed position. The relationship between the rollers 102, 104 (and effect on the napkin 14 and utensil 12) is similar to that between the first rod 36 and supporting surface 32 in the alternative embodiment of FIG. 6. In that alternative, the first rod 36 is separated from, and then brought into opposing relationship with, the supporting surface 32, as shown in FIGS. 7A and 7D. In the second alternative embodiment of FIG. 10, rollers 102 and 104 are supported at their ends by shafts 103 and 105 (only partially shown for clarity) which are preferably hinged at the hub 109. The position of rollers 102 and 104 is controlled by mechanical connection to cam follower 108 which travels in fixed cam 106 (the path of which is shown in phantom).

The drum 100 rotates by conventional connection to a motor (not shown). Each section of the drum is divided by a spoke 110, and each spoke 110 includes a vacuum means 112 at its ends which serves to receive a gummed band 92 from gummed band dispenser 90 and a napkin 14 from the napkin dispenser 62. Preferably, each spoke 110 extends across the width of the drum 100. The path of a spoke 110 as it travels on the drum will further illustrate the structure and function of this alternative embodiment. At approximately the seven o'clock position, the vacuum means 112 of spoke 110 contacts a fixed vacuum source 114, and the vacuum means 112 receives and restrains a gummed band 92 severed by cutter 94 from a roll of gummed bands. The sticky side of the band 92 faces away from the drum 100. As the spoke 110 carries the gummed band 92 to approximately the nine o'clock position, the vacuum means 112 further contacts and receives a napkin 14 delivered by the vacuum plate 78 from the stack. Part of the edge of the napkin 14 also adheres to part of the gummed band 92. As the spoke 110 continues towards the 12 o'clock position, utensils 12 are deposited upon the belt 124, preferably by means of an utensil dispenser 82 which includes a gate 89 which lowers by mechanical or electrical means in time with the drum rotation. Up to this point, the belt 124 has been static. As the spoke 110 continues past approximately the 12 o'clock position, the rollers 102, 104 close into generally opposing relationship under action of the cam 106 and cam follower 108. The belt 124 is then rotated by conventional means, such as a belt drive 116 (shown in phantom) which contacts at least one end of the surface of rollers 102, 104 or belt 124, or both, or a pin drive (not shown), or the like, in time with the drum rotation, causing the napkin 14 and utensils 12 to roll, as illustrated in FIG. 7D. This action further causes the gummed label 92 to secure the napkin 14 and utensils 12 in rolled relationship. The belt rotation is stopped, and, finally, as the spoke 110 moves to approximately the 5 o'clock position, the wrapped utensils 16 are discharged by gravity.

The alternative embodiment of FIG. 10 has the advantage of simultaneous operation upon multiple napkins 14 and utensils 12, improving production rates. As well, the napkin 14 can be dispensed with either a flat or pointed leading edge. However, the complexity of the alternative embodiment of FIG. 10 results in higher manufacturing costs.

In accordance with the present invention, the materials of construction are preferably stainless steel or corrosion resistant steel for most metallic materials. The material of flexible belt 24 (and 124) may be any flexible material which, preferably, has a coefficient of friction on the first surface 26 sufficient to induce a napkin 14 to fold and roll, and a low friction coating or quality on the second surface 28. By way of example and not limitation, a teflon coated canvas material could serve as flexible belt 24.

In a further aspect of the present invention, a method for automatically wrapping at least one utensil 12 in a napkin 14 is provided including the steps of positioning at least one utensil 12 and at least one napkin 14 in a receiving area 18, as shown in FIGS. 4A, 5A, 7A and 7E, and then manipulating the napkin 14 with an automatic wrapping mechanism 20, manually or automatically powered, to automatically wrap the napkin 14 around the utensils 12, as further illustrated in FIGS. 4B–4E, 5B–5E, and 7B–7D.

Figure 4C:
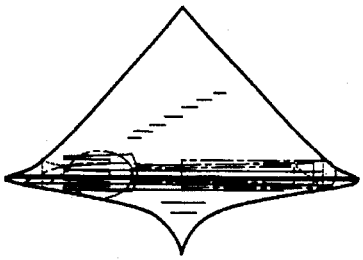
FIGS. 4A–4E are partial schematic top views of a napkin and utensils, and the belt of FIG. 3, in various stages during the wrapping process.
Figure 4E:
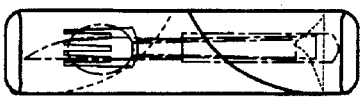
Figure 4B:
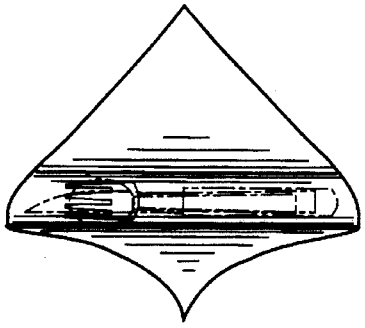
Figure 4D:
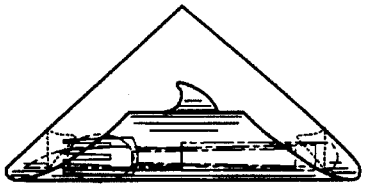
Figure 4A:
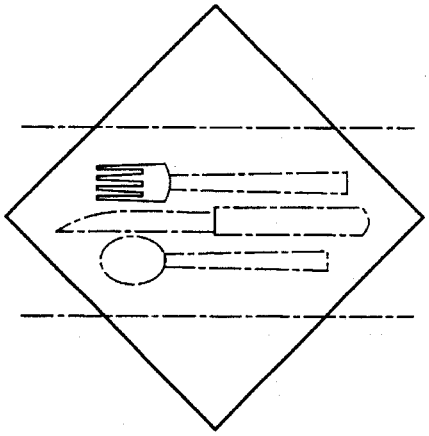

One surface of the napkin 14 may be said to include first and second side portions **14*a*, 14*c* and a central portion 14*b* therebetween, as indicated in FIG. 4A, so that, more specifically, the step of positioning includes positioning the utensil 12 in one of the portions 14*a*, 14*b*, 14*c* of the napkin 14**.

The step of manipulating includes automatically folding at least part of one of the portions over the utensils 12 into generally opposing relationship with at least part of another of the portions, as illustrated in FIGS. 4C and D, 5C and D and 7C and D, and urging the napkin 14 to roll around and wrap the utensils 12 into a bundle, or wrapped utensils 16. During the step of urging, the utensils 12 tend to move towards the central portion **14*b* of the napkin 14, and the opposing portions of the napkin tend to wrap in unison generally around the utensils 12**.

Depending upon how the step of positioning establishes the initial position of the utensil 12 on the napkin, the step of manipulating can result in wrapping the napkin 14 around the utensil 12 approximately from edge to edge, or can result in substantially folding the napkin 14 in half over the utensils 12 and rolling the opposing halves together around the utensils 12.

In accordance with FIGS. 1, 4A and 7A, it is understood that where a napkin dispenser 62 is provided, the step of positioning includes automatically positioning the napkin 14 in the receiving area 18 (or 118). Where an utensil dispenser 82 is provided, it is further understood that the step of positioning includes automatically positioning at least one utensil 12 in the receiving area 18 (or 118).

As is understood from the description of the apparatus 10, the step of manipulating is performed by frictionally engaging at least a portion of the napkin 14 with a movable portion of the flexible belt 24 (or 124), and moving that portion to urge the napkin 14 into wrapped relationship around the utensils 12. Where a means for restraining the napkin, such as a vacuum table 39 is included in the apparatus 10, the step of manipulating includes the step of initially restraining a portion of said at least one napkin 14 in a flat position in the receiving area 18 (or 118). And, where the wrapping apparatus 10 includes an element for tucking an end of the napkin 14 during wrapping(e.g. a fixed feature 21 or leaf spring 29), as shown in FIG. 3, the step of manipulating includes tucking inward an edge of the central portion **14*b* of the napkin 14. Such a tuck is desirable to produce one closed end in the bundle of wrapped utensils 16. To permit fixed feature 21 to function, the napkin 14 must be selectively placed in the receiving area 18 to engage the fixed feature 21, as shown in FIG. 2**.

The method includes further steps where additional elements are included in apparatus 10. Thus, where a gummed band dispenser 90 is included in the apparatus 10, the method of the present invention further includes the step of securing the napkin 14 in wrapped condition around at least one utensil 12. Where an automatic silverware sorting apparatus is included, the method of the present invention further includes, prior to the step of positioning, the step of automatically sorting at least one utensil 12 in an automatic silverware sorting apparatus. Finally, where an utensil dispenser 82 is included in the apparatus 10, the method includes the step of automatically delivering at least one utensil to the receiving area 18 (or 118) from the utensil dispenser 82.

Where the apparatus 10 of the alternative embodiments of FIGS. 6 and 10 are used, the method of the present invention is performed with the same steps as set forth above. In this regard, as may be understood from FIGS. 4A–4E, 5A–5E, and 7A–7E, the wrapping process imposed by the belts 24 and 124 upon the napkin 14 follows the same essential steps. Where using the alternative embodiment of FIGS. 6 and 10, the steps of feeding the napkin and utensil from a receiving area 118 may be included, as illustrated in FIGS. 7A and 7E. In addition, the step of rotating the belt 124 is included in the step of manipulating, as illustrated in FIGS. 7C and 7D.

While certain representative embodiments and details have been shown for purposes of illustrating the present invention, it will be apparent to those skilled in the art that various changes in the apparatus and method disclosed herein may be made without departing from the scope of the invention, which is defined in the appended claims.

What is claimed is:

1. A method for automatically wrapping a plurality of differently shaped, substantially rigid utensils with a napkin into a non-airtight bundle, said napkin having one surface including first and second side portions and a central portion therebetween, said method comprising the steps of:

positioning a plurality of differently shaped, substantially rigid utensils and at least one napkin in a receiving area wherein said step of positioning includes positioning said utensils in at least one of said portions of said napkins;

manipulating said at least one napkin and said plurality of utensils with an automatic wrapping mechanism, wherein said step of manipulating automatically includes:

generally surrounding said plurality of utensils with said at least one napkin wherein said step of generally surrounding includes automatically folding at least part of one of said portions over said utensils so as to be positioned opposite to and in contact with a part of another of said portions;

forming a variably shaped, non-airtight bundle of substantially rigid utensils of different shapes, said bundle including an open central structure retained by said at least one napkin;

whereby said utensils are prepared for use generally surrounded by at least one napkin.

2. The method of claim 1 wherein:

said step of automatically folding includes folding parts of said side portions into generally opposing relationship, and positioning said utensils generally within said central portion; and said step of forming comprises wrapping said opposing side portions in unison generally around said central portion and utensils therein.

3. The method of claim 1 wherein:

said step of positioning includes positioning said utensils in one of said side portions of said napkin; and said step of forming includes automatically wrapping said napkin generally around said utensils, beginning approximately at a first side portion and continuing to the other side portion.

4. The method of claim 1 wherein one surface of said napkin includes first and second side portions and a central portion therebetween, and wherein said step of manipulating includes tucking inward an edge of said central portion of said napkin.

5. The method of claim 1 wherein said automatic wrapping mechanism includes at least one flexible belt having a movable portion, and wherein:

said step of positioning is performed on a portion of at least one flexible belt which portion is defined as said receiving area; and said step of manipulating is performed automatically by:

frictionally engaging at least a portion of said napkin with a movable portion of said belt; and thereafter, performing said steps of generally surrounding and forming a non-airtight bundle by moving said movable portion of said belt.

6. The method of claim 5 wherein:

said step of manipulating is performed automatically by initially restraining a portion of said napkin in said receiving area.

7. The method of claim 1 further including the step of automatically securing said napkin with a band around the outer surface of said bundle.

* * * * *